United States Patent [19]

Phillips et al.

[11] Patent Number: 4,594,201

[45] Date of Patent: Jun. 10, 1986

[54] MULTI-FUEL SYSTEM FOR INTERNAL COMBUSTION ENGINES

[75] Inventors: Oliver V. Phillips, 10405 W. 32nd, Wheatridge, Colo. 80033; William R. Phillips, Lakewood, Colo.

[73] Assignee: Oliver V. Phillips, Wheat Ridge, Colo.

[21] Appl. No.: 600,673

[22] Filed: Apr. 16, 1984

[51] Int. Cl.[4] ..... F02M 13/06

[52] U.S. Cl. ..... 261/18 B; 123/575; 123/511; 123/515; 261/50 A; 261/88

[58] Field of Search ..... 261/18 B, 88, 50 A; 123/575, 576, 577, 578, 525, 511, 515

[56] References Cited

U.S. PATENT DOCUMENTS

| | | | |
|---|---|---|---|
| 2,409,611 | 10/1946 | Bodine | 261/18 B |
| 2,930,432 | 3/1960 | Engstrom | 261/18 B |
| 3,145,698 | 8/1964 | Crooks | 123/575 |
| 3,339,900 | 9/1967 | De Rugeris | 261/84 |
| 3,749,097 | 7/1973 | Grow | 123/575 |
| 3,920,778 | 11/1975 | De Rugeris | 261/50 A |
| 3,982,516 | 9/1976 | Abernathy | 123/575 |
| 3,991,144 | 11/1976 | Diener | 261/88 |
| 4,031,864 | 6/1977 | Crothers | 261/18 B |
| 4,207,274 | 6/1980 | Phillips | 261/50 A |
| 4,283,358 | 8/1981 | Diener | 261/88 |
| 4,306,532 | 12/1981 | Camacho | 123/525 |
| 4,421,087 | 12/1983 | Schuurman | 123/525 |
| 4,433,664 | 2/1984 | Rodrigues | 123/525 |
| 4,463,735 | 8/1984 | Stoltman | 123/525 |
| 4,465,052 | 8/1984 | Dolderer | 123/577 |

FOREIGN PATENT DOCUMENTS

| | | | |
|---|---|---|---|
| 58-122352 | 7/1983 | Japan | 123/575 |

OTHER PUBLICATIONS

Mingle, "Converting Your Car to Run on Alcohol Fuel", Oregon St. Univ., Oct. 1979.

Kirik, "Conversion of Engines to Run on Alcohol", Gasohol USA, Jun. 1981.

Vizard, "Alcohol Carbs for Racing and Street", Popular Hot Rodding, Apr. 1980.

*Primary Examiner*—Tim Miles

*Attorney, Agent, or Firm*—Vinson & Elkins

[57] ABSTRACT

A multi-fuel system which will operate the usual factory-manufactured gasoline powered internal combustion engine efficiently on any one of a number of different fuels without modifying or changing the engine. The system involves a non-venturi type of carburetor having a metered inlet and means for controlling the pressure of each fuel delivered to the inlet in accordance with the stoichiometric ratio of that fuel which assures that the proper fuel/air ratio is delivered to the mixing chamber of the carburetor without requiring any change in either the carburetor or engine when a different fuel is used. Additionally, the fuel delivered to the fuel inlet is then directed into the fuel/air mixing chamber without subjecting the fuel to the suction in the intake manifold of the engine.

10 Claims, 8 Drawing Figures

MULTI-FUEL SYSTEM FOR INTERNAL COMBUSTION ENGINES

This invention relates to new and useful improvements in multi-fuel systems for internal combustion engines.

BACKGROUND OF THE INVENTION

It is well known that internal combustion engines may be operated by many different fuels other than gasoline which presently is the major fuel for such engines. Other fuels, such as ethanol, also known as ethyl alcohol, methanol, butane and others may also be used. However, since most internal combustion engines and their carburetors are designed for efficient use of gasoline, other fuels cannot be effectively used without changes, either in the engine or its carburetor. Such changes are necessary because there exists for each fuel a particular air/fuel ratio for most efficient combustion. This chemically correct ratio of air to fuel is known as the stoichiometric ratio. As an example, the stoichiometric ratio of gasoline is 14.96 units air to 1 unit of fuel; for ethyl alcohol, also known as ethanol, the ratio is 9.01 units of air to 1 unit of ethanol and for methyl alcohol, also called methanol, 6.47 units of air to 1 unit of methanol. With these relatively wide differences in the stoichiometric ratios, it is evident that an internal combustion engine and its carburetor designed for one fuel cannot, without substantial change, operate on other fuels having substantially different air/fuel ratios.

The problem of using multiple or different fuels in the engine designed to be operated by gasoline is further complicated by the type of carburetor which is generally used with such engines. This carburetor is a Venturi type, and includes the well known venturi tube arrangement. In such structure, the suction developed by the flow of air through the venturi is depended upon to draw the gasoline or other liquid fuel, which is at atmospheric pressure, into the venturi to mix with the air and form the combustible mixture. Therefore, the air/fuel ratio in the most widely used carburetor for internal combustion engines is controlled by the suction developed in the venturi. The gasoline is at atmospheric pressure and does not control the air/fuel ratio.

In view of the foregoing, it becomes evident that an internal combustion engine designed to operate on gasoline and having a Venturi type carburetor cannot efficiently operate on other liquid fuels such as alcohol.

In recent years, the several shortages and the increased cost of hydrocarbon fuels, such as gasoline have caused a greater interest in the use of alcohol fuels, such as ethanol and methanol in internal combustion engines. The availability of ethanol which can be made in significant quantities from a variety of raw materials and its excellent operating characteristics in spark ignition internal combustion engines makes it attractive to the public and particularly to the farming community, which presently produces the grain and other raw materials from which ethanol or alcohol is made.

There is a general recognition that alcohol fuels are advantageous and conversion kits, which convert spark ignition internal combustion engines to enable them to operate on alcohol are appearing in the U.S. market (See Mart Kirik publication prepared for the Canadian National Power Alcohol Conference June 19–20, 1980 Fort Garry Hoten, Winnepeg, Manitoba, Canada). A publication by Professor John G. Mingle, of Oregon State University dated October 1979 compares the fuel properties of gasoline, methanol and ethanol and points out the advantages of alcohol fuels for internal combustion engines. The publication by David Vizard in "Popular Hot Rodding" magazine, April 1980 outlines the changes which are required to adapt the internal combustion racing engine and its carburetor to alcohol use.

The ideal modification would be to design the engine and its carburetor to operate efficiently on multiple fuels but because of the wide differences between the air/fuel ratios required for efficient operation of the engine with the various fuels, no one, to applicant's knowledge has been able to accomplish this.

All of the suggested conversions of internal combustion engines for alcohol use are directed to modification or changes either in the engine or in the carburetor, which changes adapt the engine to operate only on alcohol. Because the engine converted to operate on alcohol has difficulty in starting at lower ambient temperatures, a small volume of gasoline for start-up is sometimes used. However, because the modifications which are made in the engine or the carburetor are directed to the use of alcohol fuel, the engine cannot operate normally and efficiently on gasoline over any extended time period. Therefore, as a practical matter, the conversions which are described in the prior art provide an internal combustion engine which is capable of efficiently operating only on one fuel, such as alcohol.

OBJECTS OF THE INVENTION

As used throughout this application, the term "alcohol" is meant to include all alcohol fuels including but not limited to ethanol and methanol.

It is the main object of this invention to provide a multi-fuel system for the usual factory-manufactured, unmodified, gasoline powered internal combustion engine which permits the engine to operate efficiently on any one of a number of different fuels, as for example, alcohol or gasoline, without requiring any change or modification of said engine.

An important object is to provide a multi-fuel system for internal combustion engines wherein the usual venturi-type carburetor is not employed so that the air/fuel ratio which is directed to the engine is not dependent upon the usual pressure drop across such venturi. Instead, said air/fuel ratio is controlled by a pressure regulator and a metering valve means which forms part of a fuel/air mixer or carburetor; the regulator functioning to set the volume of fuel which can be delivered past the metering valve means at all positions of said valve means to thereby control the fuel which is conducted to the mixing chamber of the carburetor for admixture with the air during operation of the engine.

Still another object is to provide a multi-fuel system of the character described, having means for rapid and immediate changeover from one fuel to another without interrupting engine operation; said system making it possible for the engine to operate efficiently over long periods of time on the selected fuel.

A particular object is to provide a multi-fuel system wherein a single fuel/air mixer or carburetor means includes a metering valve assembly which functions in combination with a pressure regulator to set the proper fuel/air ratio of the particular fuel being delivered to the engine; the arrangement making it possible to direct different fuels through the same carburetor means and efficiently operate the same engine by properly controlling each such different fuel with a pressure regulator.

A further object is to provide a system of the character described, having a single fuel/air mixer or carburetor means capable of efficiently handling a plurality of different fuels, such as gasoline, ethanol and methanol without requiring any change in the carburetor means structure or in the engine when different fuels are employed.

A particular object is to utilize a non-venturi type of carburetor in a multi-fuel system, so that no change need be made in the internal combustion engine. One such carburetor or fuel/air mixing device is shown in the prior U.S. Pat. No. 4,207,274, to Phillips issued June 10, 1980. Other prior patents illustrating non-venturi carburetors are the U.S. Pat. Nos. 3,339,900 and 3,920,778 to De Rugeris.

DESCRIPTION OF THE PREFERRED EMBODIMENT

Figure 1:
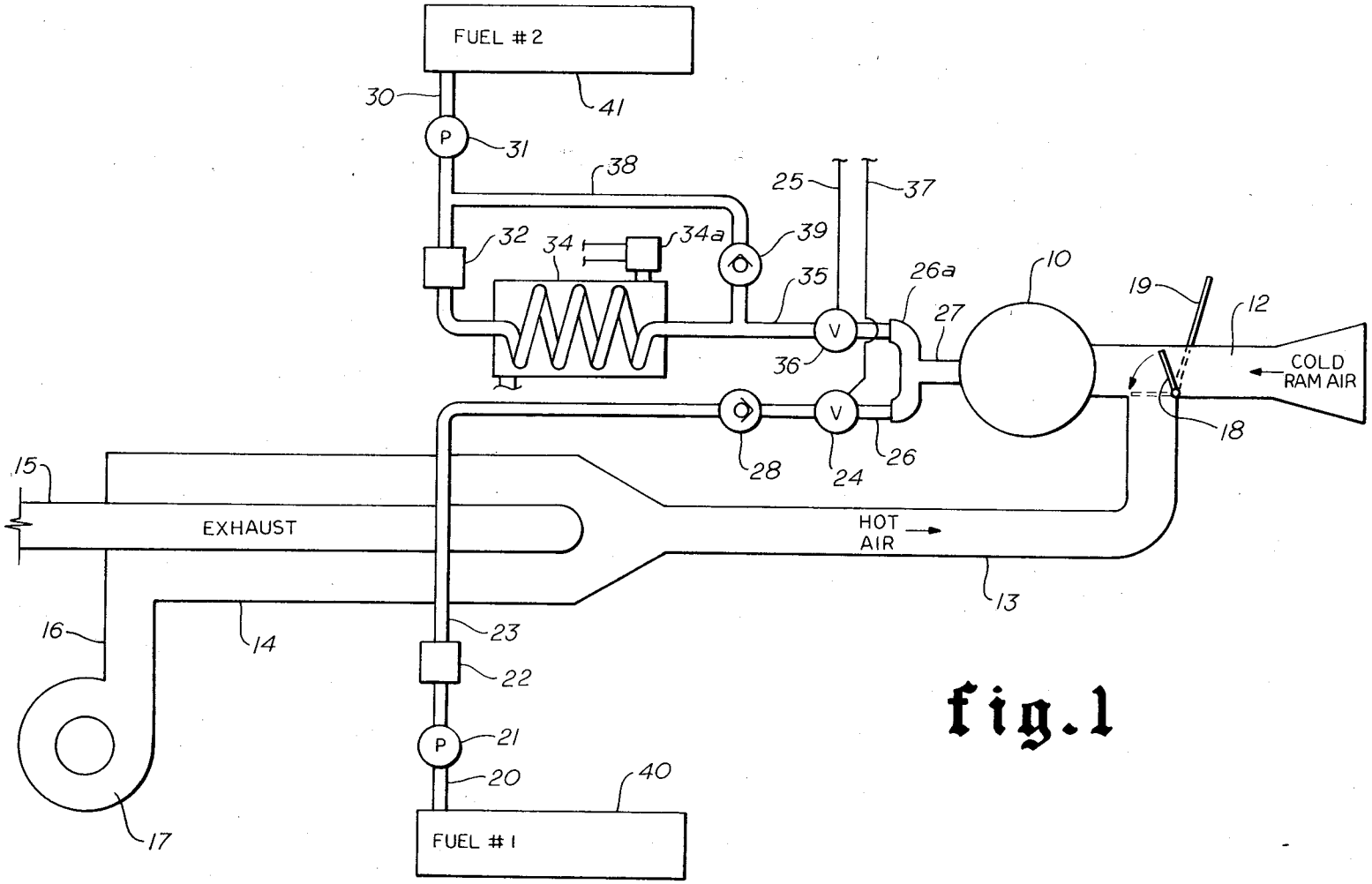
FIG. 1 is a diagrammatic view of the multi-fuel system, constructed in accordance with the invention.

In the drawings the overall system is shown schematically in FIG. 1. The carburetor 10 and air cleaner are mounted in their usual position on the upper surface of the engine. The carburetor is a non-Venturi type and will be hereinafter described in more detail but it is important to note that pressure developed across a Venturi tube is not depended upon to produce a fuel/air ratio in the combustible mixture passing to the engine.

A tubular air inlet 12 extends forwardly of the air cleaner and is adapted to collect cool air which passes through the cleaner and to the carburetor. Such cool air is utilized when using certain fuels, such as gasoline which function better under cool conditions. However, other fuels, such as alcohol, function more efficiently in a heated environment, and in such case hot air will be directed to the carburetor. For the purpose of directing heated air through the air cleaner and to the carburetor when alcohol fuel is being employed a conductor 13 extends from a tubular jacket 14 which surrounds the exhaust manifold 15 of the engine and said jacket has connection through a pipe 16 with a blower 17. A valve 18 located adjacent the intersection of the hot-air pipe 13 and the cool-air inlet 12 may be actuated through a control 19 from inside the passenger compartment of the vehicle; when so operated, either cool or hot air is directed to the carburetor, depending upon the fuel being used. The use of blower 17 is optional.

A first fuel which will be designated gasoline is stored in a tank T-1 aboard the vehicle and its outlet line 20 is connected to a fuel pump 21. The pump 21 pumps the gasoline to a pressure regulator 22, the outlet of which regulator is connected through a pipe 23 to a control valve 24. The control valve is preferably an electrical valve operated through the well-known solenoid and is controlled through an electrical line 25 which extends into the passenger compartment of the vehicle. Beyond the valve 24 the gasoline line is connected to one branch 26 of an inlet 27 extending to the carburetor. If desired a backcheck valve 28 which prevents reverse flow through the gasoline line 23 may be mounted between the pressure regulator and the solenoid actuated valve 24. As will appear later, the pressure regulator co-acts with a metering orifice in the carburetor 10 to properly control the gasoline/air ratio of the combustible mixture directed to the engine.

The second fuel to be used with the system, which will be assumed to be alcohol, has a supply line 30 extending from a tank T-2 carried by the vehicle and is connected to a fuel pump 31. From the fuel pump the flow is through a pressure regulator 32, and then through a conductor 33 to a heater 34. The heater may be controlled by an electric valve **34*a* which is operated from the passenger area of the vehicle. The outlet pipe 35 from the heater extends to a control valve 36 which, like the control valve 24, is preferably electrically operated. The electrical line 37 which controls actuation of valve 36 extends back into the vehicle passenger compartment so that the position of the valve may be remotely controlled. The outlet from the control valve 36 has connection with a branch line 26*a* of the connection 27 which connects into the carburetor and conducts the alcohol to said carburetor. For the purpose of preventing excessive pressure build-up in the alcohol circuit, a bypass line 38 having a one-way check valve 39, may connect the pipe 35 back to the supply line between the regulator 32 and the fuel pump 31. In the event too much pressure builds up in the alcohol circuit beyond the heater, the check valve 39** opens to relieve such pressure.

Figure 2:
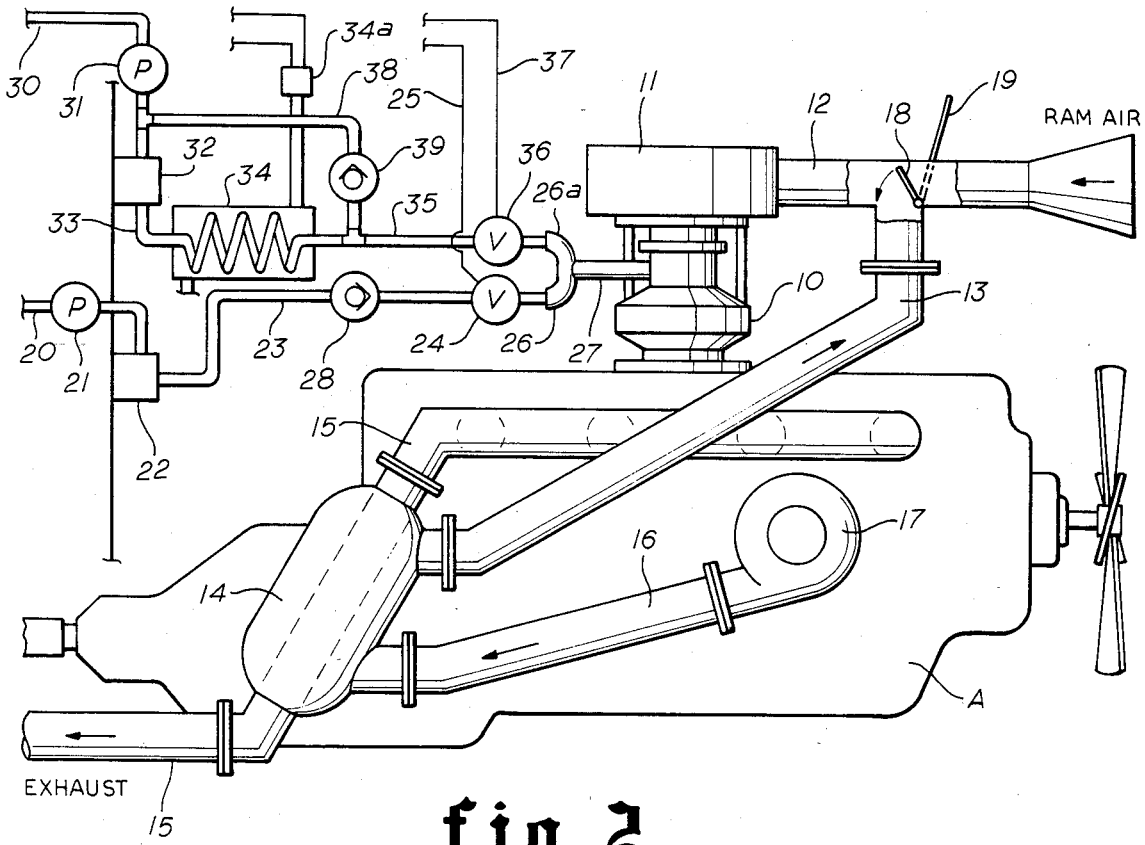
FIG. 2 is a schematic view of a multi-fuel system, illustrating the same as applied to the engine of a vehicle, said engine being shown only in general outline.

In FIG. 2, the system is laid out schematically with regard to an engine to show the location of the components relative to said engine. However, in FIG. 2 neither fuel tank T-1 or T-2 is shown but as has been stated, these tanks would be mounted on the vehicle in the most convenient area.

The carburetor 10 is mounted upon the engine with the air cleaner 11 located atop the carburetor. The cold air inlet 12 extends in a forward direction while the hot air pipe 13 angles downwardly and rearwardly from the cold air conductor to connect with the tubular jacket 14 which surrounds the exhaust manifold 15. The blower 17 for the heated air is mounted at the side of the engine and connects to the jacket 14 through a pipe 16. The fuel pumps 21 and 31, as well as the pressure regulators are preferably mounted on the usual fire wall which is ordinarily forward of the vehicle dashboard. The heater 34 may be suitably secured by appropriate brackets to either the engine or firewall. As has been stated, the controls which effect the shifting from one fuel to another, as well as all other necessary controls are located in the passenger area of the vehicle to be readily accessible to the vehicle operator.

When the engine is operating on gasoline the valve 24 is open while valve 36, which controls the flow of alcohol to the carburetor, is closed. It is usual to start the engine on gasoline, particularly in cold weather, and in such case the valve 18 in the air inlet is in a lowered position to direct cold air to the carburetor. Because the control of the gasoline/air ratio is by the pressure regulator, the efficiency is such that if desired the engine may continue to operate on gasoline, and it may never be desired to shift over to the alcohol. However, because alcohol has advantages over gasoline and is available since it is produced from growing grains and because it burns cleaner, it may be more desirable to operate the engine with the alcohol fuel. With the present system either fuel will operate the engine efficiently.

The multi-fuel system of this invention is made possible by eliminating a Venturi-type carburetor and by controlling the fuel/air ratio with a pressure regulator. As previously pointed out, a Venturi-type carburetor depends upon developing a suction to create a flow of air which in turn, draws the fuel which is at atmospheric pressure into the Venturi tube to mix with the air and form the combustible mixture. Because there is a wide difference in the stoichiometric ratio of gasoline to air as compared to the stoichiometric ratio of alcohol with air, it is impossible to efficently operate an engine alternately on either one fuel or another where the Venturi-type carburetor is employed.

In applicant's system, the carburetor may be one such as shown in the U.S. Pat. No. 4,207,274 issued June 10, 1980 to Oliver V. Phillips, one of the co-applicants. In this carburetor there is no Venturi and none is depended upon to introduce the fuel. By properly adjusting each pressure regulator for each fuel in accordance with its stoichiometric ratio and not depending upon a Venturi suction, it is possible to switch from one fuel to another while maintaining efficient operation of the engine. No change in either the carburetor or the engine is necessary. It might be noted, that in the case of alcohol, the regulated pressure which is required for efficient operation is approximately one and a half to three times as much as the regulated pressure required for gasoline in order to move the same volume through the carburator. The ability to achieve different air/fuel mixtures by thus controlling the fuel inlet pressure has made it possible to operate the same engine with the same carburetor on both fuels.

Figure 3:
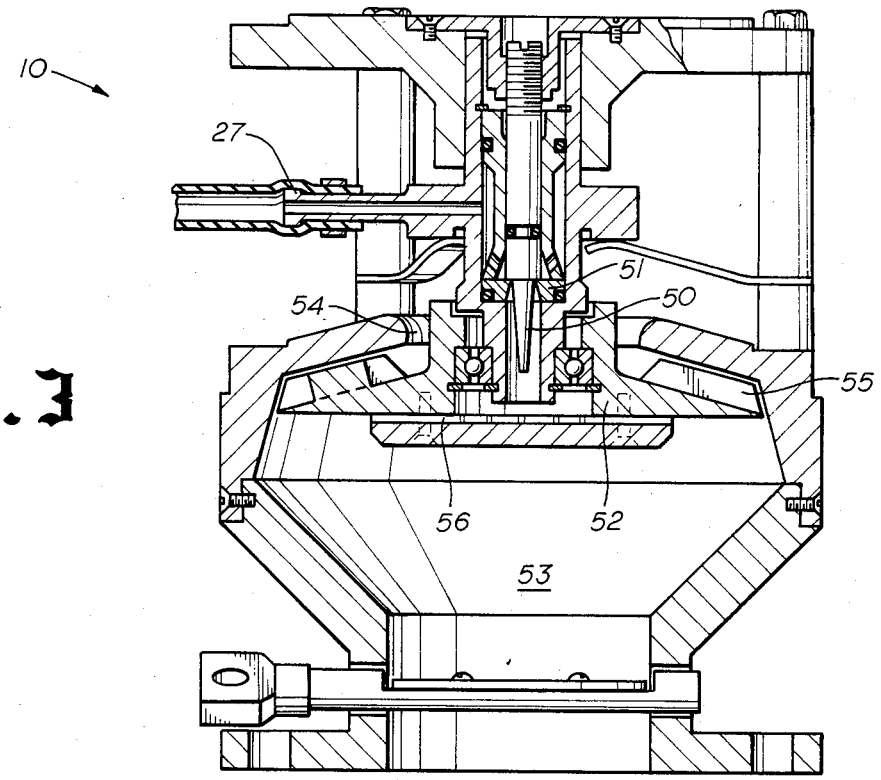
FIGS. 3 and 3A are vertical sectional views of one type of non-venturi type of carburetor or fuel/air mixer which has been found satisfactory for use in the multi-fuel system of this invention.
Figure 3A:
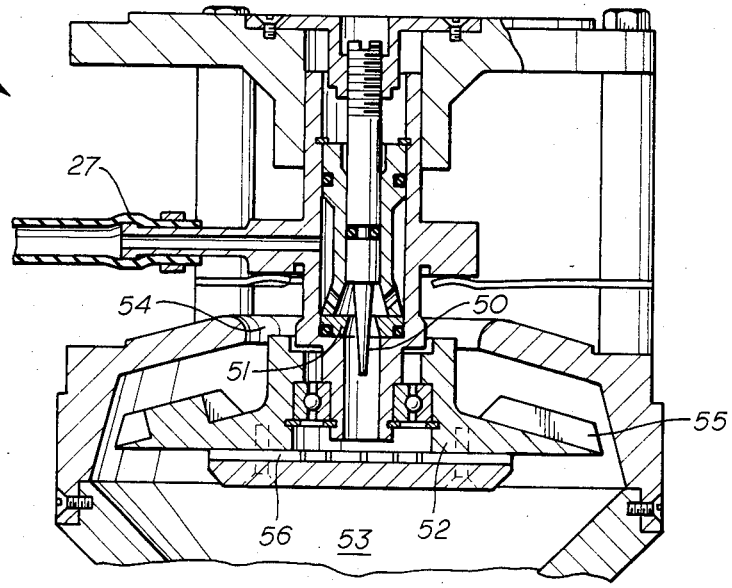

The carburetor shown in FIGS. 3 and 3A is a duplicate of the carburetor shown and described in the prior U.S. Pat. No. 4,207,274. For the sake of clarity, only the main elements of the carburetor are herein identified by numerals which numerals are different from the numerals identifying the same main elements in said prior patent.

The various elements of the carburetor illustrated herein include a metering pin 50 which is secured in a fixed position within a housing. A seat 51 which is mounted at the upper end of a rotor assembly 52 is movable vertically with respect to the metering pin. The rotor assembly is acted upon by the engine suction and as it is drawn downwardly, the space between seat 51 and metering pin increases. The inlet 27 for the fuel enters the carburetor above the seat as is shown in FIG. 3. Air enters the mixing chamber 53 of the carburetor through the area 54, which surrounds the upper portion of the rotor. The rotor is formed with angle fins 55, and as the air flows over and through these fins the rotor is rotated. The fuel which passes the metering pin is discharged from the rotating member through radial passages 56 at the lower end of the member.

The specific details of the operation of this type of carburetor is fully explained in U.S. Pat. No. 4,207,274, and such patent is incorporated herein by reference.

In operation of the system, there is provided for both fuels a single metered entrance. In other words, the gasoline enters the mixing chamber of the carburetor through the same opening and past the single metering pin as does the alcohol when the shift to alcohol occurs. Additionally, particular fuel which is entering through the inlet 27 is under its particular adjusted pressure. This pressure is preset in accordance with the stoichiometric ratio of the fuel to assure that the proper mixture of fuel and air is passed to the engine, whereby efficient operation of the engine will result. Both fuels, gasoline and alcohol in this case, enter the carburetor or mixing device at the same point. They both pass the single metering pin with the volume passing said pin being controlled by the movement of the rotor assembly as affected by engine suction and by pressure as set by the particular pressure regulator controlling that fuel. The improved result of being able to shift from one fuel to another is brought about by the combination of the single metering valve with pressure regulation of the particular fuel being used. Although two fuels have been described, namely: gasoline and alcohol, the system could supply additional fuels by providing another source and another pressure regulator, so that a third fuel, such as butane, could be used.

In the prior U.S. Pat. No. 4,207,274, the fuel is ejected through the passages 46 at the lower end of the rotor. In this area the passages are exposed to the suction of the engine as it draws down the assembly. Since this suction effect varies with the load on the engine, it was found that there may be some interference with the proper mixture.

Figure 6:
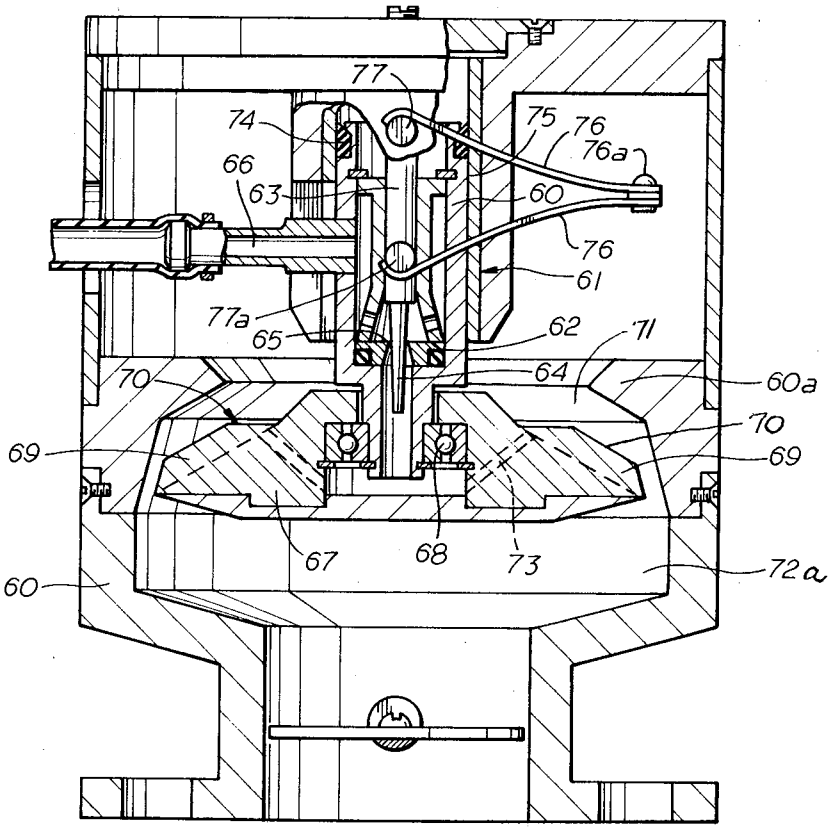
FIG. 6 is a view, similar to FIG. 5, with the metering valve unseated.
Figure 5:
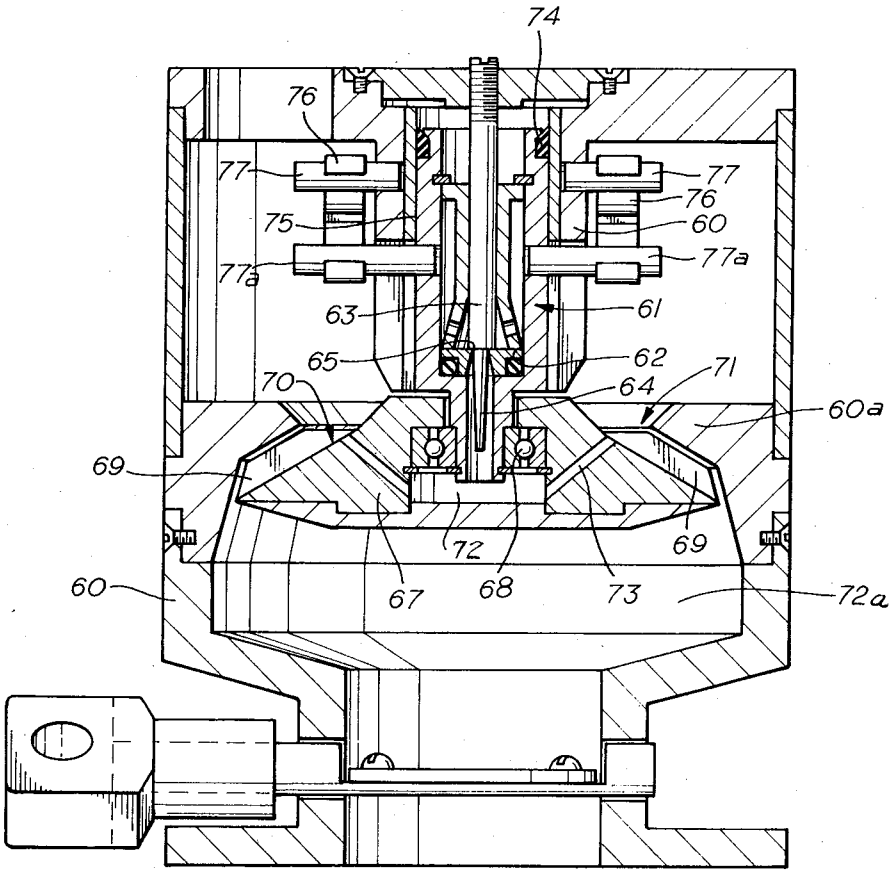
FIG. 5 is a vertical, sectional view of a modified form of non-venturi type of carburetor for use with the multi-fuel system.
Figure 7:
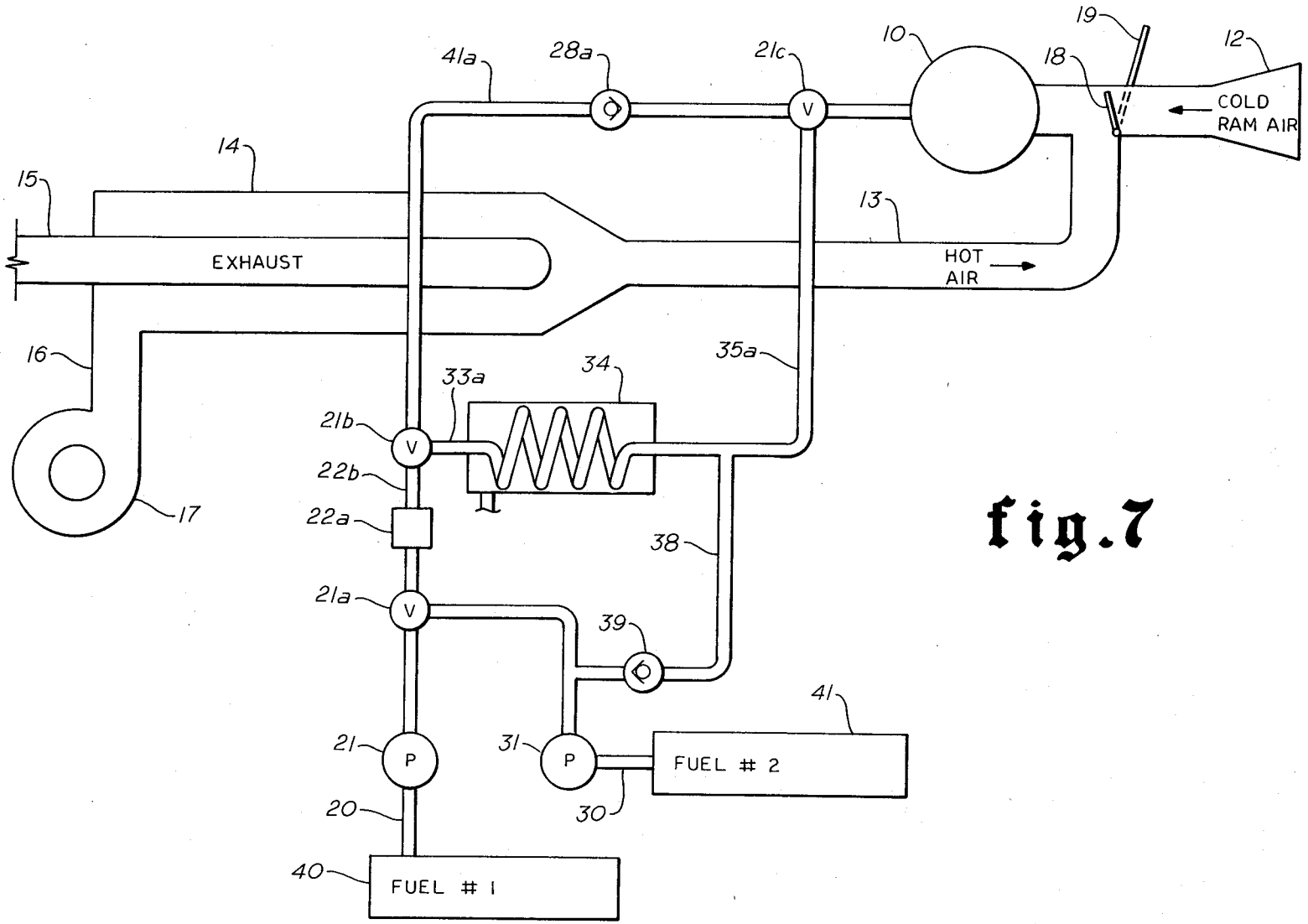
FIG. 7 is a diagrammatic view of a system wherein each of the multiple fuels are directed through the same pressure regulator.

In order to eliminate any possibility of the suction effect interfering with the proper fuel/air mixture, an improved type of carburetor (as compared to that illustrated in the prior U.S. Pat. No. 4,207,274) may be employed. Such carburetor, illustrated in FIGS. 5, 6 and 7, is generally similar in configuration and operates in a manner similar to that of the carburetor shown in said prior patent.

The improved carburetor includes a housing 60 having its lower portion forming a fuel/air mixing chamber which communicates with the intake manifold of the engine. A rotor assembly 61 is mounted for vertical movement within the housing and is constantly urged upwardly by suitable spring means. The rotor assembly has a central bore and nearer the lower portion of such bore an annular flat valve seat 62 is formed. Adjustably mounted in the upper portion of the housing and extending axially downwardly therein is an elongated pin element 63, a major portion of which is of a constant diameter. Below the constant diameter section is a tapered metering pin 64 and at the intersection of the pin and the constant diameter section, there is formed an annular flat valve seating surface 65 which is adapted to co-act with the flat valve seat 62 to control flow through the central bore of the rotor assembly. A fuel inlet 66 is flexibly connected into one side of the rotor assembly and communicates with the area surrounding the metering pin 64 just above the flat annular valve seat 62. Thus, when the rotor assembly is moved downwardly, the flat annular seat 62 in the lower portion of the rotor assembly moves downwardly away from the seating surface 65, and the fuel may flow past the metering pin 64 and enter the lower portion of the central bore in said rotor assembly. As soon as the flow begins past the seating surface, the metering pin 64 functions to control and meter such flow in direct relationship to the amount of movement of the rotor assembly. Upward movement of the rotor assembly reengages the seat 62 and surface 65 to shut off flow of fuel downwardly past the metering pin.

The rotor assembly 61 includes a rotor 67 mounted for rotation upon suitable bearings 68 which are supported in the lower end of said rotor assembly. The rotor is a circular member generally conical in shape and when in its uppermost position, (FIG. 5) its upper and annular exterior surfaces are in close proximity to the interior walls of the carburetor housing 60. The upper surface of said rotor is formed with grooves 69 which are disposed at an angle with respect to radial directions extending from the rotor center. The provision of the grooves 69 forms a plurality of upstanding fins or blades 70 on the upper surface of the rotor and such fins or blades are also disposed at an angle to a true radial direction. The grooves are open at both ends, to provide air channels or passages in the upper surface of the rotor. The lower section of the housing 60 has a circular portion 60*a* which overlies the major extent of the air channels and the area between the inner periphery of the portion 60*a* and the lower end of upper body portion of the housing 60 is open and is in fact, the air inlet 71 to the mixing chamber 72*a* of the housing.

When the rotor 67 initially moves downwardly from its uppermost position, the air entering inlet 71 is forced to abruptly change direction of flow. This applies a substantial force to the fins or blades because of the inertia force developed by such rapid change of direction which assures immediate and rapid rotation of the rotor. As the rotor moves downwardly into the mixing chamber of the housing, an additional volume of air is admitted to the chamber. At the same time, the downward movement of the rotor assembly effects the unseating of the valve seat 62 and fuel is thereby admitted to the lower end of the central bore of said rotor assembly.

Formed within the central portion of the rotor 67 is a circular chamber or cavity 72 which communicates with the lower end of the central bore of the rotor assembly. Thus, when the fuel valve is open, flow of fuel is past the metering valve and directly into said cavity. Extending radially and upwardly from the central cavity 72 and to an area close to and in communication with the air inlet 71 are a plurality of passages or channels 73. Each passage has its exit end between the upstanding fins or blades 70, whereby the fuel exiting from the passage is directly in the line of flow of air which is entering the mixing chamber of the carburetor housing. Since the exit area of each passage is not directly exposed to the suction in the mixing chamber 72*a*, such suction does not affect the fuel/air ratio passing to the engine. It might be noted that the prior U.S. Pat. No. 4,207,274 provided fuel passages which were in the bottom of the rotor and therefore, the fuel/air mixture was sometimes affected by engine suction. The present arrangement exposes the passages 73 to atmospheric pressure and provides a definite advantage over prior art units.

Experience has shown that when alcohol is being used, some of the alcohol will tend to leave deposits in some areas of a carburetor of the type shown in U.S. Pat. No. 4,207,274. It has been found that where the alcohol is sealed off when the fuel valve is closed, deposits of fusel oil may occur. In the carburetor shown in prior U.S. Pat. No. 4,207,274 and in FIG. 5 herein, when the metering valve is closed, the annular space surrounding the fuel valve is sealed off by the fuel valve at its lower end and by an o-ring seal at its upper end. A small amount of leakage was found to occur upwardly past the o-ring and then downwardly between the sliding portion of the rotor assembly and the housing wall. This leakage left small deposits of fusel oil on the walls which interfered with smooth movement of the rotor assembly. To avoid this problem, the modified carburetor eliminates any seal around the tubular member and instead provides a seal 74 between the upper end of the rotor assembly 61 and the inner wall of a liner 75 mounted within the outer housing 60. With this arrangement, there is no accumulation of foreign material in the annular area around the upper portion of the rotor assembly.

Figure 4:
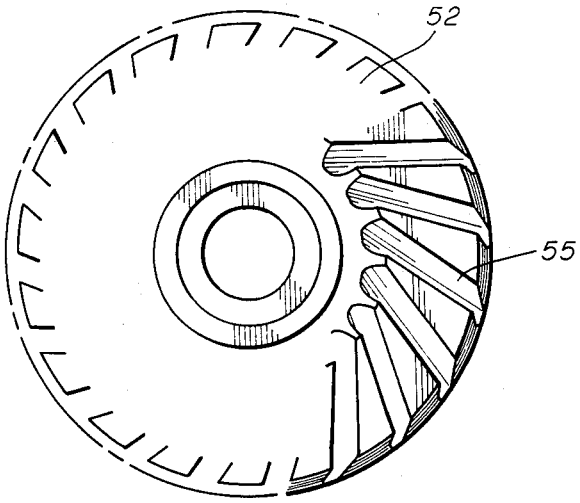
FIG. 4 is a plan view of the rotor illustrating the fins on its upper surface.

Another modification involves the type of springs which are used in the modified form shown in FIGS. 4 and 5. Although the springs disclosed in prior U.S. Pat. No. 4,207,274 work satisfactorily, it was found that they occupied substantial space and also applied some sideward pressure to the rotor assembly during movement. In the modified form, a connecting bolt 76*a* is secured to one end of a pair of flat springs 76. As shown in FIG. 6, the springs are curved away from each other toward the center of the unit and have their ends engaging pins 77 and 77*a* which keep such ends spread apart. Since the pins are spread apart, the springs are under tension and exert their forces upon the stationary pin 77 mounted in the housing of the carburetor and the pin 77*a* secured to the movable rotor assembly. This action of the springs urges the rotor assembly upwardly toward closed position. To properly balance the spring forces, one set of springs is mounted on each side of the rotor housing. It is pointed out that the springs are merely suspended from the pins 77 and 77*a* by their own spring forces and actually float or move with the rotor assembly to apply a straight up and down tension without sideward pressure.

The operation of the modified form is generally the same as that of the carburetor disclosed in the prior U.S. Pat. No. 4,207,274 and it is deemed unnecessary to repeat such operation in detail. Briefly, the suction of the engine draws the rotor assembly downwardly which immediately admits the proper volume of air into the mixing chamber through the air inlet 71. The admission of air rotates the rotor by the force of the flowing air. At the same time, the fuel is admitted and is controlled by the metering pin, after which it is directed through the upwardly inclined passages or channels 73 into the air stream at a point above the suction which is developed in the mixing chamber 72*a*. As has been noted, since the volume of fuel is not affected by the suction in said mixing chamber, its control is solely in accordance with the pressure at which the fuel enters the device and the size of the metering opening. Because it is the pressure and the metering pin which controls the proper fuel/air ratio, the use of several different fuels may be used without any change in the carburetor or engine.

In FIGS. 1 and 2 the control system has been illustrated with two fuel systems; that is, each fuel has its own pressure regulator. It is possible to arrange the system so that both fuels employ the same pressure regulator but in such case, it is necessary when shifting from one fuel to another to readjust the pressure regulator as the changeover is made. Such a system is illustrated in FIG. 7, wherein the gasoline tank 40 has its fuel pump 21 connected with a two-way control valve 21*a*, one outlet of which has a connection with a pressure regulator 22*a*. The outlet line 22*b* from the pressure regulator passes to another two-way control valve 21*b* and then the flow is through a line 41*a* to the carburetor 10. A third two-way control valve 21*c* is connected in this line as is the backcheck valve 28*a*.

When operating on gasoline, the control valves 21*a*, 21*b* and 21*c* are moved to a position directing flow of gasoline through the pressure regulator and to the carburetor. At this time the alcohol fuel is completely shut off. The regulator is adjusted to the required pressure so that the proper gasoline/air ratio is conducted to the carburetor. This assures efficient engine operation.

When changing the operation to use alcohol, the pressure regulator 22*a* is adjusted to a pressure which will control the alcohol/air ratio of the fuel flowing to the engine. Also the valves 21*a*, 21*b* and 21*c* are manipulated to close flow of gasoline to the carburetor. The alcohol tank 41 has its outlet line connected to valve 21*a* so that flow passes through the regulator 22*a*, and then through control valve 21*b* and through line 33*a* to the heater 34. From the heater, flow of alcohol is through line 35*a*, control valve 21*c* and into the carburetor. The pressure relief line 38 and its check valve 39 extend between the alcohol outlet conductor from the fuel pump 31 to the outlet side 35*a* of the heater.

It will be evident that the system shown in FIG. 7 will operate in substantially the same manner as the system shown and described in FIG. 2. It is somewhat less convenient to use the system of FIG. 7, because it is necessary to adjust the pressure regulator 22*a* and three valves 21*a*, 21*b* and 21*c* to the fuel each time that the fuel is changed. It is also somewhat more complicated in that the three two-way control valves 21*a*, 21*b* and 21*c* would have to be included in the system so as to direct either gasoline or alcohol to the carburetor. However, aside from these slight disadvantages, the system would operate exactly as the independent system of FIG. 2. In both cases the fuel/air ratio is controlled by the combination of a pressure regulator with a single metering valve; such single metering valve may be combined with any number of pressure regulators to properly control the fuel/air ratio passing to the engine in accordance with the particular fuel being used.

What we claim is:

1. A multi-fuel system for an internal combustion engine including, a carburetor having an air inlet and a fuel inlet and means for mixing said air and liquid fuel to form a combustible mixture which is conducted to the engine to operate the same; a first liquid fuel supply assembly having means for regulating the pressure of said first fuel which is to be supplied to the fuel inlet of said carburetor;

a second liquid fuel supply assembly having means for regulating the pressure of said second fuel which is to be supplied to the fuel inlet of said carburetor;

means for selectively directing either the first or second liquid fuel to the carburetor to operate the engine on such selected fuel; means in each fuel supply assembly for selectively adjusting the regulated pressure of each fuel delivered to the fuel inlet of the carburetor, said pressure being set in accordance with the fuel being used to assure that the required fuel/air ratio of the combustible mixture is supplied to the engine.

2. A multi-fuel system for internal combustion engine as set forth in claim 1, together with metering means associated with the fuel inlet to meter the flow of fuel into said carburetor, said metering co-acting with the regulated pressure to control the proper fuel/air mixture being delivered to the engine.

3. A multi-fuel system for an internal combustion engine as set forth in claim 1, together with a metering element associated with the fuel inlet to meter the volume of flow passing through said inlet, and means for controlling the position of said metering element in accordance with the suction developed by the operating engine.

4. A multi-fuel system for an internal combustion engine including, a fuel/air mixing device having an air inlet and a fuel inlet;

a first fuel supply assembly having a fuel tank;

a supply line between the tank and the fuel/air mixing device;

a fuel pump in said line;

a pressure regulator in the line;

a control valve for controlling flow of fuel through the line to the inlet of the mixing device;

means for setting selectively the pressure of the regulator in accordance with the particular composition of the first fuel to assure delivery of the proper fuel/air ratios for combustion to said mixing device when the control valve is open and the first fuel is being used to operate the engine;

a second fuel supply assembly having a fuel tank;

a supply line between the tank and the fuel/air mixing device;

a fuel pump in said line;

a pressure regulator in the line;

a control valve for controlling flow of fuel through the line to the inlet of the mixing device;

means for setting selectively the pressure of the regulator in accordance with the particular composition of the second fuel to assure delivery of the proper fuel/air ratios for combustion to said mixing device when the control valve is open and the second fuel is being used to operate the engine;

and a metering element in the fuel inlet to control the volume of fuel passing through said inlet, whereby the metering element and the regulated pressure co-act to control the fuel/air ratio of the combustible mixture regardless of which fuel is being used.

5. A multi-fuel system for internal combustion engines as set forth in claim 4 wherein, said metering element is responsive to and its position is controlled by the suction developed by the engine being operated.

6. As a subcombination in a fuel system for an internal combustion engine, a carburetor comprising, a housing having a fuel/air mixing chamber in its lower portion and a fuel inlet in its upper portion;

an air inlet in the upper end of the mixing chamber;

a rotor assembly movable vertically within said housing and co-acting with the air inlet to substantially close the same when said assembly is at the end of its travel in one direction relative to the housing and to open said air inlet upon movement of the assembly in the opposite direction;

a rotor rotatably mounted on said assembly;

a metering element mounted in a fixed position in the housing and co-acting with the fuel inlet to meter the flow through the inlet;

a metering orifice carried by the rotor assembly and movable with respect to the metering element to thereby control flow of fuel through the fuel inlet, such movement of the rotor assembly simultaneously moving the assembly relative to the housing to control the volume of air entering said fuel-/air mixing chamber;

a plurality of fuel discharge passages in the rotor and having their inner ends in communication with the metered flow passing through the fuel inlet;

each discharge passage extending from the lower central portion of the rotor to the upper outer periphery of the rotor, whereby fuel from said passages is discharged into the air entering the mixing chamber adjacent the air inlet;

means for exposing the rotor assembly to the suction of the engine being operated whereby the volume of air and fuel entering the mixing chamber is controlled by said suction;

means for spinning said rotor as the rotor assembly is drawn downwardly, whereby the fuel is discharged into the area above the upper surface of the rotor in a multitude of streams to assure entrainment and distribution of the fuel throughout the air within the mixing chamber;

a floating spring means engaging a projection on the fixed housing and a projection on the upper portion of the rotor assembly for urging the latter in a direction closing the fuel inlet; and said floating spring means comprising a pair of flat springs secured together at one end;

the other end of each spring being bowed away from each other to engage said projections on the housing and rotor assembly.

7. A multi-fuel system for an internal combustion engine including, a fuel/air mixing device having an air inlet and a fuel inlet;

a gasoline supply assembly having a fuel tank having gasoline therein;

a supply line between the tank and the fuel/air mixing device;

a fuel pump in said line;

a pressure regulator in the line;

a control valve for controlling flow of gasoline through the line to the inlet of the mixing device;

means for setting the pressure of the regulator in accordance with the stoichiometric ratio of gasoline to assure delivery of the proper fuel/air ratios for combustion to said mixing device when the control valve is open and the gasoline is being used to operate the engine;

an alcohol supply assembly having a fuel tank having alcohol therein;

a supply line between the tank and the fuel/air mixing device;

a fuel pump in said line;

a pressure regulator in the line;

a control valve for controlling flow of fuel through the line to the inlet of the mixing device;

means for setting the pressure of the regulator in accordance with the stoichiometric ratio of the alcohol to assure delivery of the proper fuel/air ratio for combustion to said mixing device when the control valve is open and alcohol is being used to operate the engine;

and a metering element in the fuel inlet to control the volume of alcohol passing through said inlet, whereby the metering element and the regulated pressure co-act to control the fuel/air ratio of the combustible mixture regardless of which fuel is being used.

8. A multi-fuel system for internal combustion engines as set forth in claim 7, wherein said metering element is responsive to and its position controlled by the suction developed by the engine being operated.

9. A multi-fuel system for an internal combustion engine including a fuel/air mixing device having a fuel inlet, an air inlet and means for mixing fuel and air and conducting such combustible mixture to the engine;

a first fuel supply assembly;

a second fuel supply assembly;

means for selectively directing either the first or second fuel to the fuel inlet of the fuel/air mixing device to mix said fuel with the air entering the air inlet of the device to form a combustible mixture;

means in each fuel supply assembly for regulating the pressure of its fuel which is delivered to the fuel inlet of the device, said pressure being set in accordance with the stoichiometric ratio of the particular fuel being used to assure that the proper fuel/air ratio of the combustible mixture is delivered to the engine; and metering means responsive to engine suction being associated with said fuel inlet of the fuel/air mixing device to control the volume of fuel flowing through said inlet and wherein said first fuel is gasoline, and said second fuel is alcohol.

10. A multi-fuel system for an internal combustion engine including a fuel/air mixing device having a fuel inlet, an air inlet and means for mixing fuel and air and conducting such combustible mixture to the engine;

a first fuel supply assembly;

a second fuel supply assembly;

means for selectively directing either the first or second fuel to the fuel inlet of the fuel/air mixing device to mix said fuel with the air entering the air inlet of the device to form a combustible mixture;

means in each fuel supply assembly for regulating the pressure of its fuel which is delivered to the fuel inlet of the device, said pressure being set in accordance with the stoichiometric ratio of the particular fuel being used to assure that the proper fuel/air ratio of the combustible mixture is delivered to the engine; and metering means responsive to engine suction being associated with said fuel inlet of the fuel/air mixing device to control the volume of fuel flowing through said inlet and wherein the first fuel is gasoline, and the second fuel is alcohol produced from grain.

* * * * *